US007857291B2

(12) United States Patent
Dombroski

(10) Patent No.: US 7,857,291 B2
(45) Date of Patent: Dec. 28, 2010

(54) FLEXIBLE FENCE ASSEMBLY

(76) Inventor: Edward L. Dombroski, 16 Catskill Ave., Poughkeepsie, NY (US) 12603

( * ) Notice: Subject to any disclaimer, the term of this patent is extended or adjusted under 35 U.S.C. 154(b) by 0 days.

(21) Appl. No.: 12/100,499

(22) Filed: Apr. 10, 2008

(65) Prior Publication Data

US 2008/0217598 A1 Sep. 11, 2008

Related U.S. Application Data

(63) Continuation-in-part of application No. 11/809,065, filed on Jun. 1, 2007, now abandoned, which is a continuation-in-part of application No. 11/143,895, filed on Jun. 2, 2005, now abandoned.

(51) Int. Cl.
*E04H 17/16* (2006.01)
*E01F 7/02* (2006.01)

(52) U.S. Cl. ..... 256/24; 256/12.5; 256/DIG. 2

(58) Field of Classification Search ..... 256/12.5, 256/24, 23, 13, 26, 27, DIG. 2; 160/184, 160/349.1
See application file for complete search history.

(56) References Cited

U.S. PATENT DOCUMENTS

| | | | | | |
|---|---|---|---|---|---|
| 58,300 | A | | 9/1866 | Rose | |
| 69,445 | A | | 10/1867 | Johnson | |
| 155,660 | A | * | 10/1874 | McGinty | 256/34 |
| 810,260 | A | | 1/1906 | Bugby | |
| 1,376,150 | A | | 4/1921 | Millar | |
| 1,749,068 | A | * | 3/1930 | De Land | 47/22.1 |
| 3,011,316 | A | * | 12/1961 | Wilson | 405/28 |
| 3,101,929 | A | | 8/1963 | Dvore | |
| 3,214,916 | A | * | 11/1965 | Martin | 405/28 |
| 3,473,786 | A | * | 10/1969 | Luebke | 256/12.5 |
| 3,711,066 | A | | 1/1973 | Niemiec | |
| 3,770,245 | A | | 11/1973 | Murdock | |
| 3,933,311 | A | | 1/1976 | Lemelson | |

(Continued)

FOREIGN PATENT DOCUMENTS

DE 2616778 A1 * 11/1977

(Continued)

*Primary Examiner*—Joshua T Kennedy
(74) *Attorney, Agent, or Firm*—Joseph L. Spiegel; Heslin Rothenberg Farley & Mesiti P.C.

(57) ABSTRACT

A fence assembly is made up of a plurality of fence sections. Each section is made up of panels with top, bottom and side edges and front and rear surfaces. Slots are spaced from and milled into the panels along one of the sets of edges. A pair of trim extends over and covers the set edges and each trim has projections that snap or slide into the front and rear slots. Alternatively the edges of the panel may be beaded and slid over the slotted side of the trim. The fence sections are coupled pivotably to fence posts such that the panels may pivot, under force of wind, about either their top or bottom end. The panels are restored to generally vertical position by the force of gravity. A counterweight within the fence post linked to the panels can be used to restore panels to their vertical position. In an alternate embodiment, the brackets coupling the panels to the fence posts may slide along the fence posts and the panels bow in response to high winds. The fence panels may include resilient strips along their vertical edges.

5 Claims, 17 Drawing Sheets

U.S. PATENT DOCUMENTS

| | | | | | |
|---|---|---|---|---|---|
| 4,089,179 | A | * | 5/1978 | Trautman | 405/74 |
| 4,671,495 | A | * | 6/1987 | Garland et al. | 256/12.5 |
| 5,177,890 | A | * | 1/1993 | Hisatomi et al. | 40/447 |
| 5,372,354 | A | * | 12/1994 | Cacicedo | 256/22 |
| 5,702,090 | A | | 12/1997 | Edgman | |
| 5,795,099 | A | * | 8/1998 | Parker | 405/28 |
| 6,053,480 | A | | 4/2000 | De Guise | |
| 6,126,145 | A | * | 10/2000 | Mohr | 256/24 |
| 6,595,497 | B1 | * | 7/2003 | Linford et al. | 256/19 |
| 6,719,277 | B2 | | 4/2004 | Ohanesian | |
| 7,523,921 | B2 | * | 4/2009 | Garrity | 256/67 |
| 2007/0090334 | A1 | * | 4/2007 | Laws et al. | 256/24 |
| 2007/0125994 | A1 | * | 6/2007 | Henning | 256/12.5 |

FOREIGN PATENT DOCUMENTS

| | | | | |
|---|---|---|---|---|
| GB | 2241000 | A | * | 8/1991 |
| GB | 2245611 | A | | 1/1992 |
| GB | 2258476 | A | * | 2/1993 |
| GB | 2264514 | A | | 9/1993 |

* cited by examiner

FLEXIBLE FENCE ASSEMBLY

CROSS-REFERENCE TO RELATED APPLICATION

The present application is a continuation-in-part of my patent application Ser. No. 11/809,065, entitled Flexible fence Assembly, filed Jun. 1, 2007, now abandoned, which is, in turn, a continuation-in-part of my application Ser. No. 11/143,895, entitled "Flexible Fence Assembly" filed June 2, 2005, now abandoned. These previous applications are incorporated herein by this reference and the benefit of the filing dates of these applications are claimed herein as well.

BACKGROUND OF THE INVENTION

1. Field of the Invention

This invention relates to fencing such as the type that might be used in suburbs for enclosing one's property and, in particular, to a type of fence assembly that will allow for wind passage therethrough without sacrificing privacy.

2. Description of the Prior Art

Especially in areas where strong winds frequently occur, fence rigidity is required. Otherwise in a strong wind the fence will not be able to withstand the force of the wind and be knocked over. Even where the fences are rigid, a very strong wind can cause damage to the fence and as the fence ages even less force is required to damage the fence and blow it over.

SUMMARY OF THE INVENTION

Accordingly, an object of the invention is a fence that will allow passage of wind therethrough without sacrifice of privacy.

Another object is such a fence that is lightweight and extremely flexible in terms of dimensions and color selection.

Still another object is such a fence that is easy to install, remove, replace and store. A further object of the invention is to enable a 'snap-together' assembly for a manufacturing cost reduction.

A still further object is to enable greater post spacing through the use of longer, corrugated fence panels or equivalent.

These and other objects, features and advantages are accomplished in accordance with the teachings of the present invention, one illustrative embodiment of which comprises a fence assembly made up of a plurality of fence sections. Each section is made up of panels with top, bottom and side edges and front and rear surfaces. Slots are spaced from and milled into the panels along one of the sets of edges. A pair of trim extends over and covers the set edges and each trim has projections that snap or slide into the front and rear slots. Alternatively the edges of the panel may be beaded and slid over the slotted side of the trim. The fence sections are coupled pivotably to fence posts such that the panels may pivot, under force of wind, about either their top or bottom end. The panels are restored to generally vertical position by the force of gravity. A counterweight within the fence post linked to the panels can be used to restore panels to their vertical position.

In an alternate embodiment, the brackets coupling the panels to the fence posts may slide along the fence posts and the panels bow in response to high winds. The fence panels may include resilient strips along their vertical edges.

BRIEF DESCRIPTION OF THE DRAWING

Other objects, features and advantages of the present invention will be apparent from the following detailed description and accompany drawing, wherein.

DETAILED DESCRIPTION

Figure 1A:
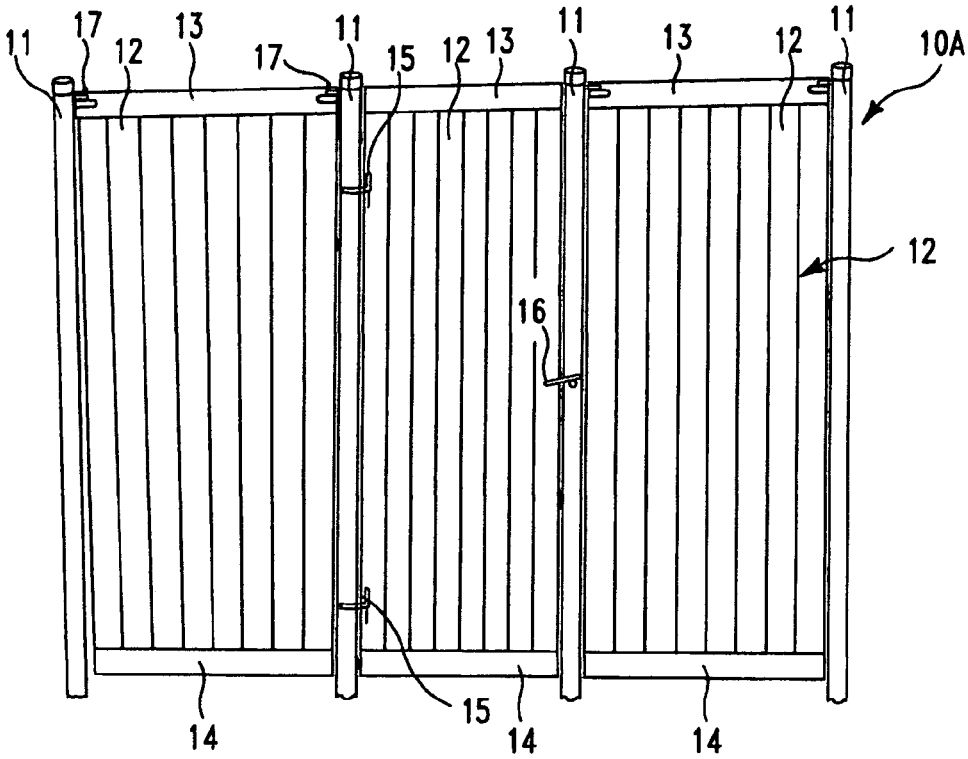
FIG. 1A is a front elevation of a portion of a fence assembly, constructed in accordance with the teachings of the present invention, including a gate.

Referring to FIG. 1A of the drawing, one embodiment of the novel fence assembly 10A of the present invention is seen as including vertical posts 11, a plurality of main bodies or panels 12, and top 13 and bottom 14 trim. In this embodiment the left-most and right-most panels 12 are secured to the vertical posts 11 (in a manner to be explained hereafter) so as to pivot about the top, while the middle panel is hinged at 15 and provided with a latch 16 so as to function as a gate within the fence assembly 10A. The posts 11 can be of any cross-section, e.g. round, square, rectangular, etc. and can be made of wood, steel, plastic, etc., so long as they are rigid.

Each panel 12 may be a complete sheet or, as illustrated, a plurality of joined-together sheets as, for example, like multiple sheets of vinyl house siding, and made in different lengths, widths and color, depending on the site and application.

Each panel 12 is provided with an extruded, upper 13 and lower 14 trim that extends over and covers the top and bottom edges of the panels 12. The trims are affixed to the panel, either by screwing or, when spring is provided to the trim, by snapping or sliding the trims onto the edges of the panel as will be explained hereafter. The trims 13,14 are of a flexible plastic material. In areas where strong winds frequently occur, the need for fence rigidity is required. The trims 13,14 provide rigidity as well to the panel. The trim is made of ABS, vinyl or equivalent. Optionally, the bottom trim 14 can be omitted. The top trim 13 is also used in securing the panel 12 to the posts 11, but in a manner to allow, with the bottom part of the panel 12 unsecured, the panel to pivot about its top length.

With the panels 12 thus mounted, the fence assembly allows the left and right panels 12 to pivot under a wind's force and thus allow wind flow through the fence assembly 10A. When the wind subsides, gravitational forces, in this instance the weight of the panels 12, return the panels 12 to their normally vertical position.

Figure 1B:
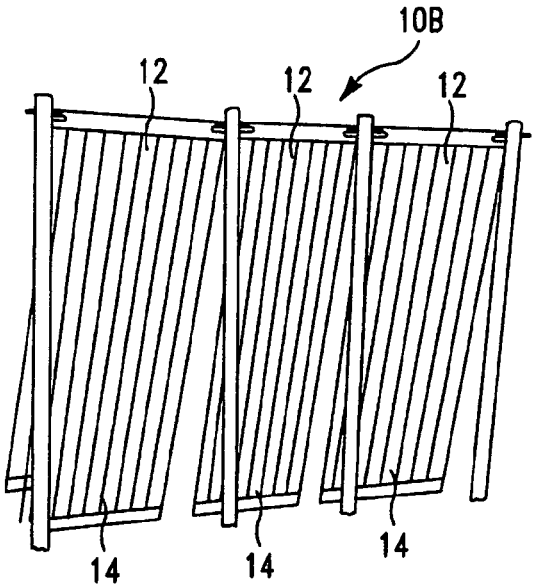
FIG. 1B is a perspective view of the backside of a portion of an alternate fence assembly, showing the effects of wind action on the assembly's panels and where the panels pivot about their top length.

The embodiment 10B depicted in FIG. 1B is similar to the embodiment in FIG. 1A, but without a gate so that all panels 12 pivot about their top length. The figure depicts a possible position of the panels 12 due to the effects of a wind's force.

The embodiment 10C differs from the FIGS. 1A and 1B embodiments in that in this embodiment the fence assembly 10C is constructed, in a manner to be explained hereafter, so that the panels 12 pivot about their bottom length. The panels 12 are shown in a possible position due to the effects of a wind's force. When the wind subsides counterweights (not shown in FIG. 1C), suspended within the poles 11 and tied to the top of the panels 12 will return the panels to their normal vertical position.

Figure 2C:
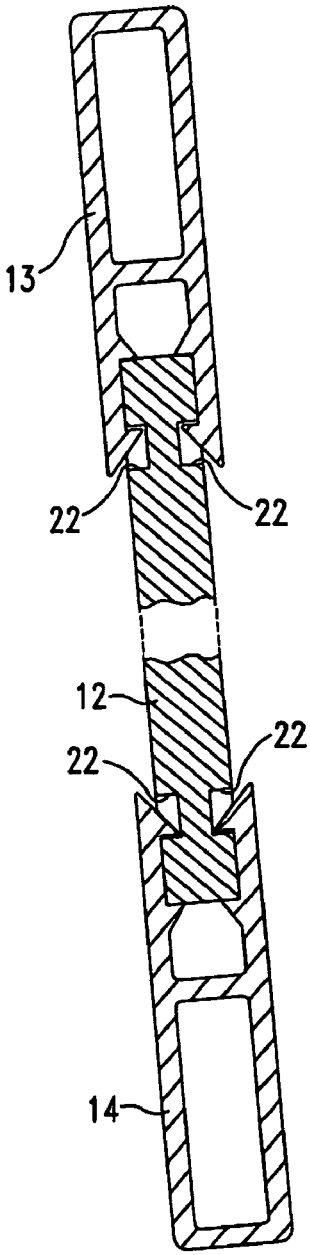
FIG. 2C is a side sectional, fragmentary view, showing a top trim and a bottom trim snapped onto a piece of siding.
Figure 2A:
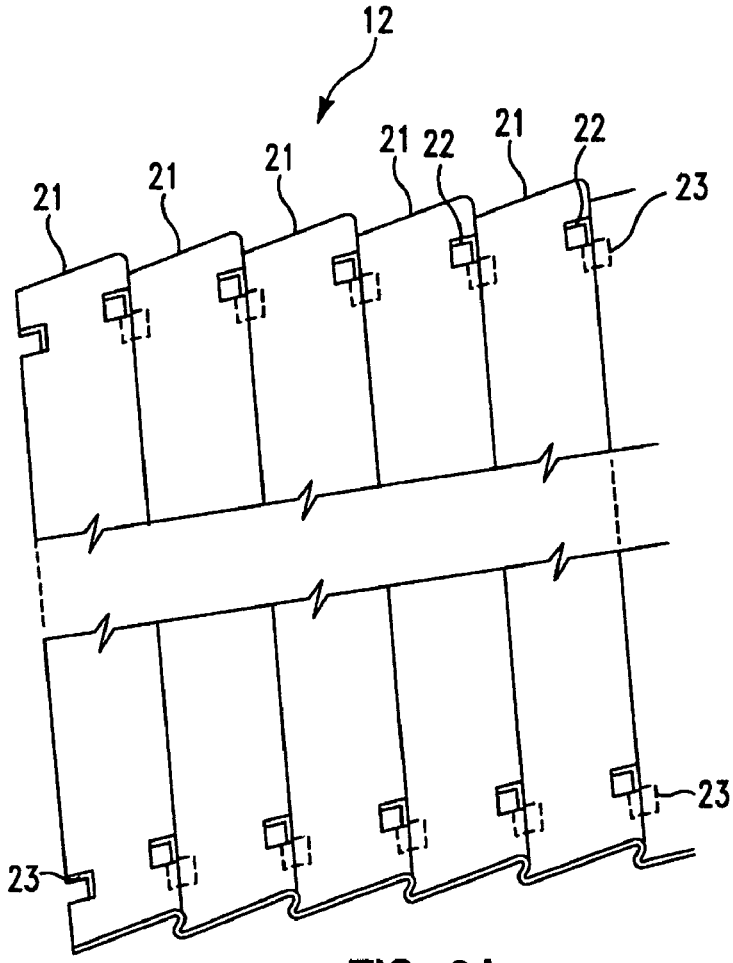
FIG. 2A is a fragmentary, perspective view of a main body or panel made up of standard house-siding or a single sheet equivalent, with mill cuts or notches across the top and bottom of each siding piece or sheet.
Figure 2B:
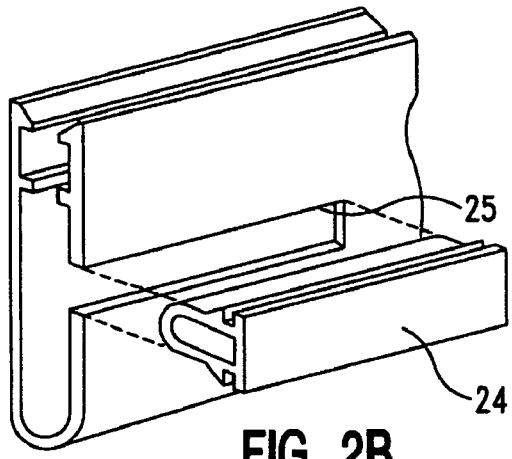
FIG. 2*b* is a fragmentary, perspective view of a trim piece with an insertable cover for the pivot pins entrance slot.

Each main body or panel 12 may be a complete sheet or, as illustrated in FIG. 2A, a plurality of snapped-together sheets 21 of vinyl house siding, typically of 3/64 inch thickness.

The sheets are mill-cut or notched, typically 1/8 inch deep along the top at 22 and bottom at 23, in both the front and back to form little lips for a snap-on assembly of the upper trim 13 and lower trim 14 rather than necessitating the use of screws to secure the trim to the siding.

Figure 9A:
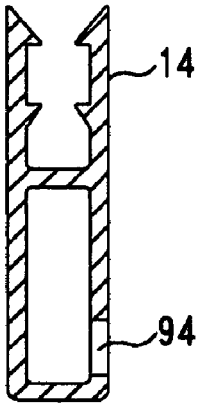
FIG. 9A is a cross-sectional view of the trim showing the pin entrance at the bottom when pivoting action is at the bottom length of the panel.
Figure 9B:
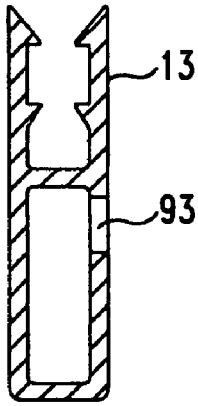
FIG. 9B is a cross-sectional view of the trim showing the pin entrance at the top when pivoting action is at the top length of the panel.

To be explained hereafter pivot pins 55 (See FIG. 5C) are press-fit into the vertical posts 11 and then inserted within openings in the trim (93 in FIG. 9B). A removable cover 24 may be press-fit into a slot 25 within lower trim 14. The cover 24 is primarily for aesthetic purposes, but also prevents accidental panel/post dis-connect. In the FIG. 5C embodiment, the opposite post has been omitted from the view. It should be understood that only the backside of the top and bottom trim has the openings for the pivoting pins.

Also, where house siding is used to form a fence panel, each slotted edge normally used for house attachment must be trimmed for aesthetic value.

Figure 3B:
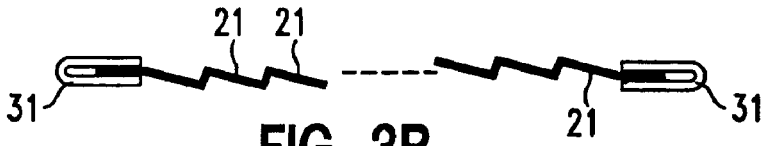
FIG. 3B is a top view of FIG. 3A.

In the FIG. 1A embodiment, the middle panel functions as a gate. With the middle panel made up of pieces of siding 21, the adjacent siding alone would be inadequate to support a hinge and latch assembly. In this instance and referring to FIGS. 3A, 3B and 3E, both the right and left edges of the gate panel 12 (in this instance made up of siding 21) are provided with a more substantial vertical trim piece 31 on the order of 1/8 inch thickness that runs the entire length of the siding 21. Hinges 15 are secured to the vertical trim piece 31 by means of rivets or screws 32 that pass through the siding 21. Adjusting screws 17 (FIG. 1A) may be included in the event a skewed condition develops between posts 11 and panel 12.

Figure 3D:
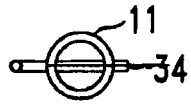
FIG. 3D is a top view of FIG. 3C.
Figure 3A:
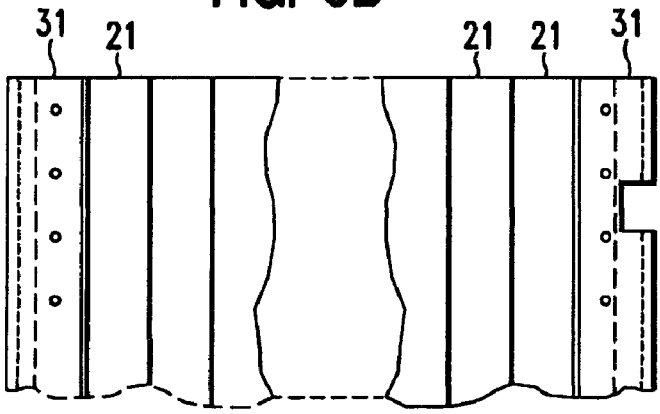
FIG. 3A is a fragmentary, side view of a portion of a main body or panel made up of siding, to which has been added a vertical trim for support for a hinge.
Figure 3C:
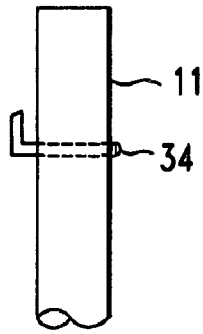
FIG. 3C is a fragmentary side view of the post in FIG. 1A in which pins are located for the gate's pivot.

FIGS. 3C and 3D disclose the post 11 in which two L-shaped pins 34 are embedded and on which the gate can pivot.

Figure 3E:
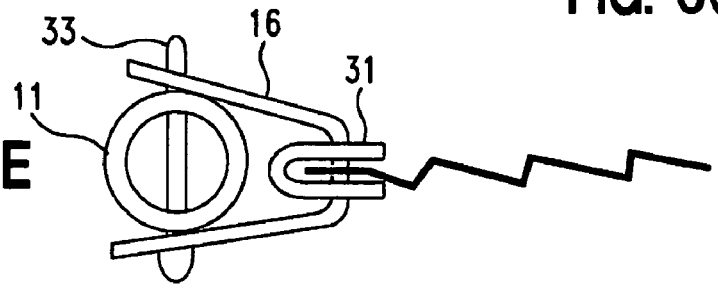
FIG. 3E is a top, fragmentary view showing the latch assembly of the FIG. 1A embodiment secured on the pin embedded in the vertical post.
Figure 3F:
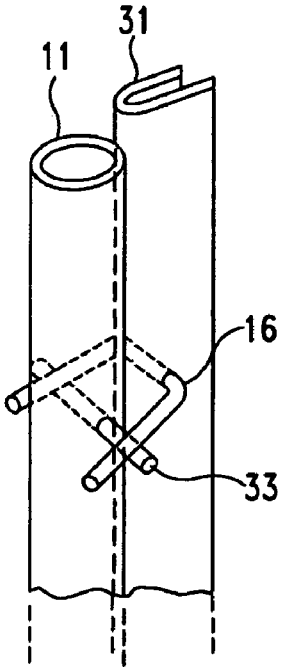
FIGS. 3F and 3G are fragmentary perspective views showing the positioning and relationship of the post, pin, latch, vertical trim piece and siding.
Figure 3G:
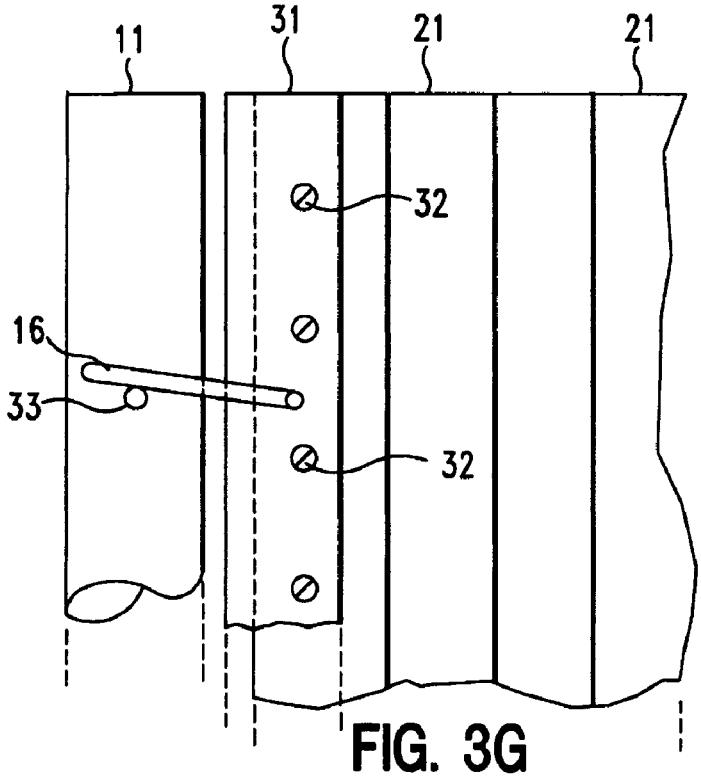

FIG. 3E is a top view showing the latch 16 secured on the pole, while FIGS. 3F and 3G show the positioning and relationship of the post 11, its pin 33, latch 16, vertical trim piece 31 and siding 21.

Figure 1C:
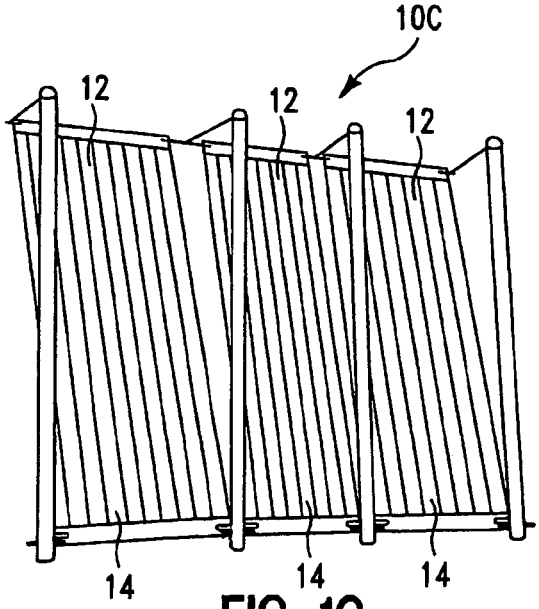
FIG. 1C is a perspective view of the backside of another alternate embodiment, showing the effects of wind action on the fence assembly's panels where the panels pivot about their bottom length.
Figure 4:
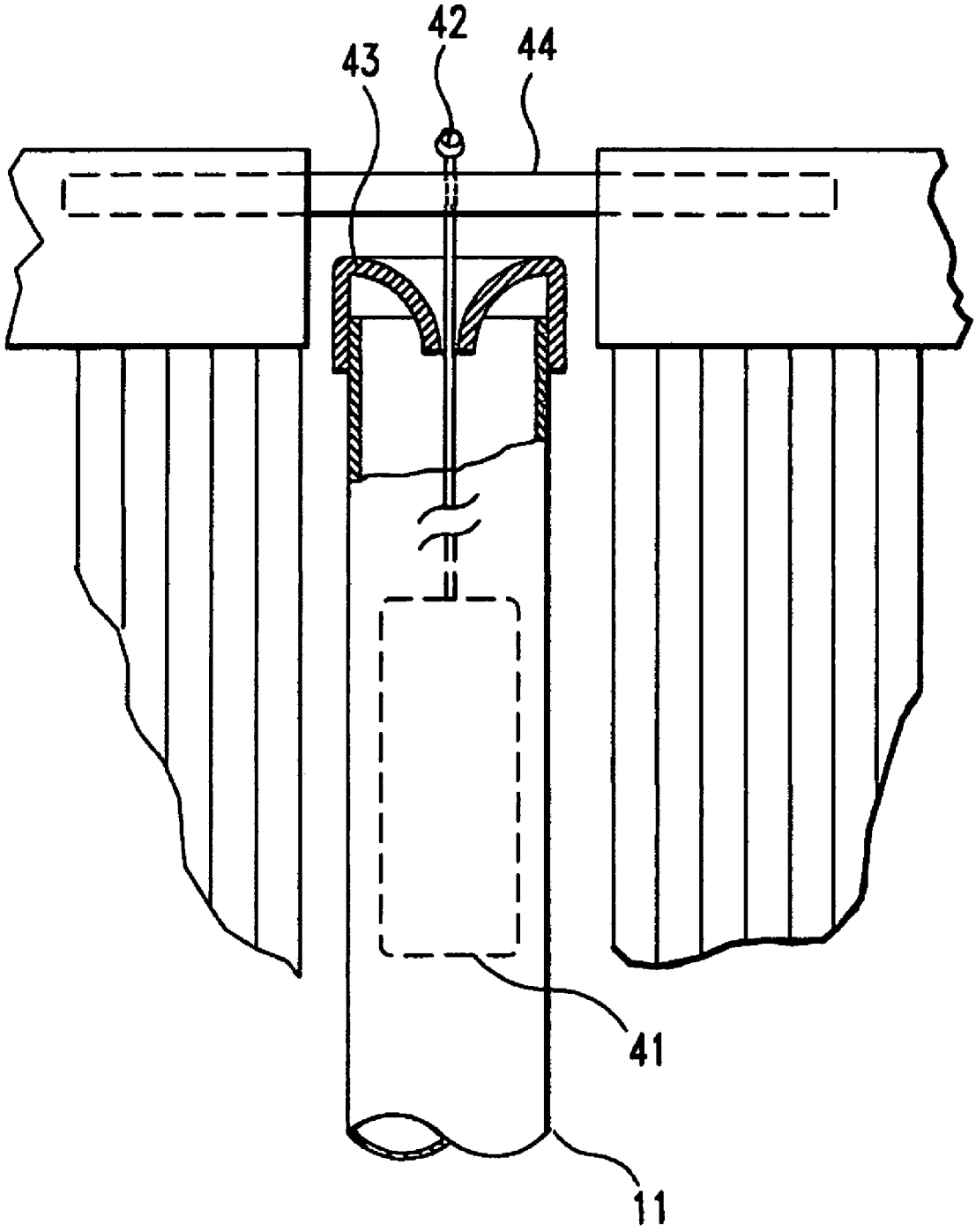
FIG. 4 is a fragmentary, side view of a portion of the FIG. 1C embodiment showing the makeup of the counterweight assembly when the pivoting action is along the bottom length of the fence assembly.
Figure 5A:
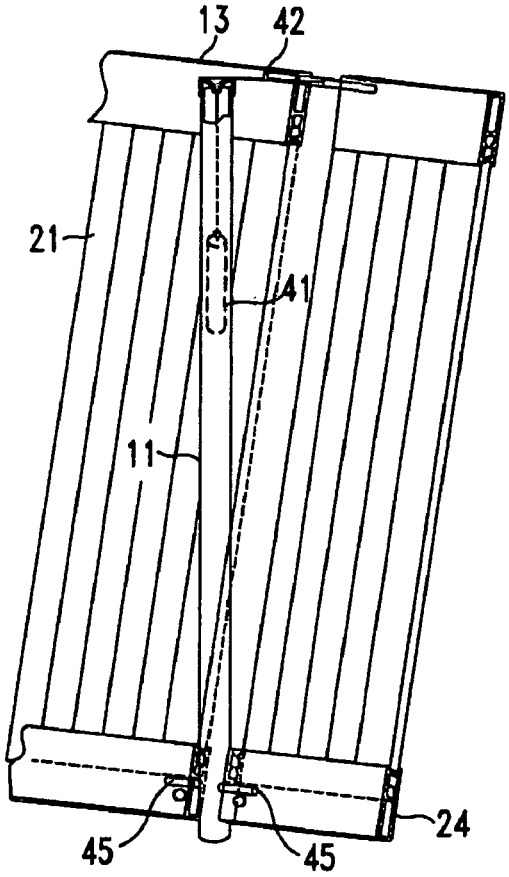
FIG. 5A is a fragmentary, perspective view of the FIG. 1C embodiment where pivoting is about the bottom length and showing the effect of the wind's force on the fence assembly panels.

Referring now to FIGS. 1C, 4 and 5A, in this embodiment the fence assembly 10C is constructed so that the panels 12 pivot about their bottom length. In FIG. 4, counterweights 41 are shown suspended within the poles 11 and tied by means of cord 42, as of braided nylon, that passes through a molded pole cap 43 to pins 44 affixed to the upper trim 13 of adjacent panels 12. Pivot pins 45 are inserted within openings in the trim (94 in FIG. 9A) and into the vertical posts 11. In the FIG. 1C embodiment, the fence assembly 10C is shown in a possible position due to the effects of a wind's force. When the wind subsides the counterweights 41 will return the panels 12 to their normal vertical position.

There may be times when you wish to confine a child or pet within a fenced area, or when moderate winds are expected and no wind passage through the fence assembly is needed. In those instances, and referring to FIG. 5B, the fence post 11 is provided with a threaded rivet 51 near ground level. A locking bar 52 is centered in and between two adjacent bottom-trim members 14. To lock the fence assembly in closed position, a screw 53 is threaded through the locking bar 52 and fastened to the threaded rivet 51 in the fence post 11. Alternatively, instead of screwing through the locking bar 52 to the post 11, a semi-circular clamp 54, is fastened by means of the locking screw 53 to the threaded rivet 51 in the fence post 11. The locking bar 52 is eliminated.

Figure 5C:
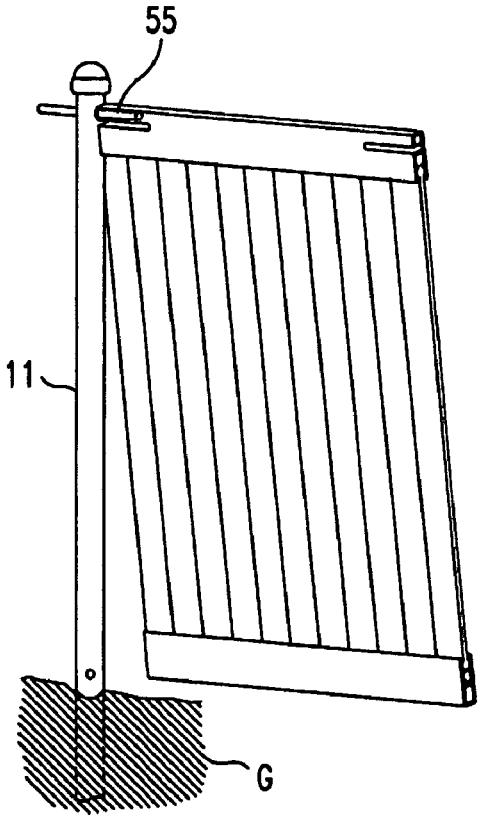
FIG. 5C is a perspective view of one of the panels in the FIG. 1A or 1B embodiments where the pivoting is about the top length showing the effect of the wind's force on the panel and further showing the fence assembly post embedded in concrete.
Figure 5B:
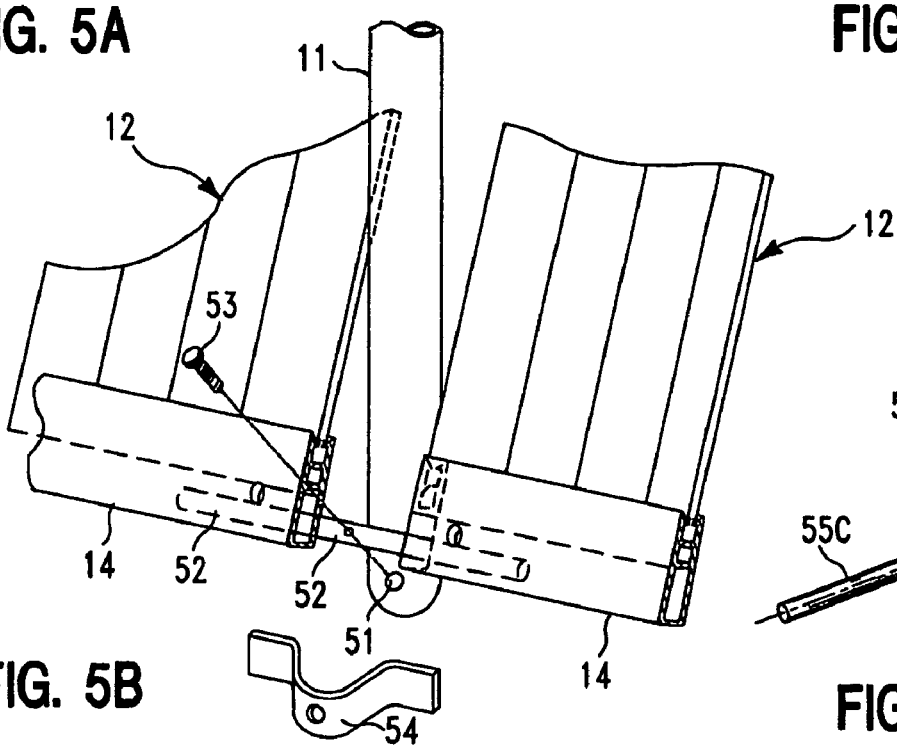
FIG. 5B is a fragmentary, perspective view of the base of the FIG. 1B embodiment and when locking the fence assembly in closed position.

FIG. 5C discloses a fence post 11 that is embedded in the ground G or concrete, as the case may be. A single panel 12 that pivots about its top length is illustrated. A pin 55 inserted into the post 11 and within the trim 13 supports the panel 12.

Figure 5D:
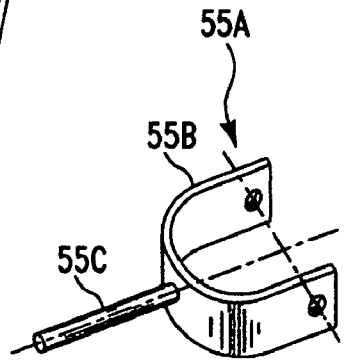
FIG. 5D is a perspective view of a pin with casting used when irregular terrain requires a pivot height change and/or for cornering.

Referring to FIG. 5D, where there is irregular terrain height or the fence assembly reaches a corner, accommodation for same is accomplished by the use of the variable height pivot pin 55A that includes a metallic casting 55B with two pilot holes for pop rivets and the pin 55C.

Figure 6A:
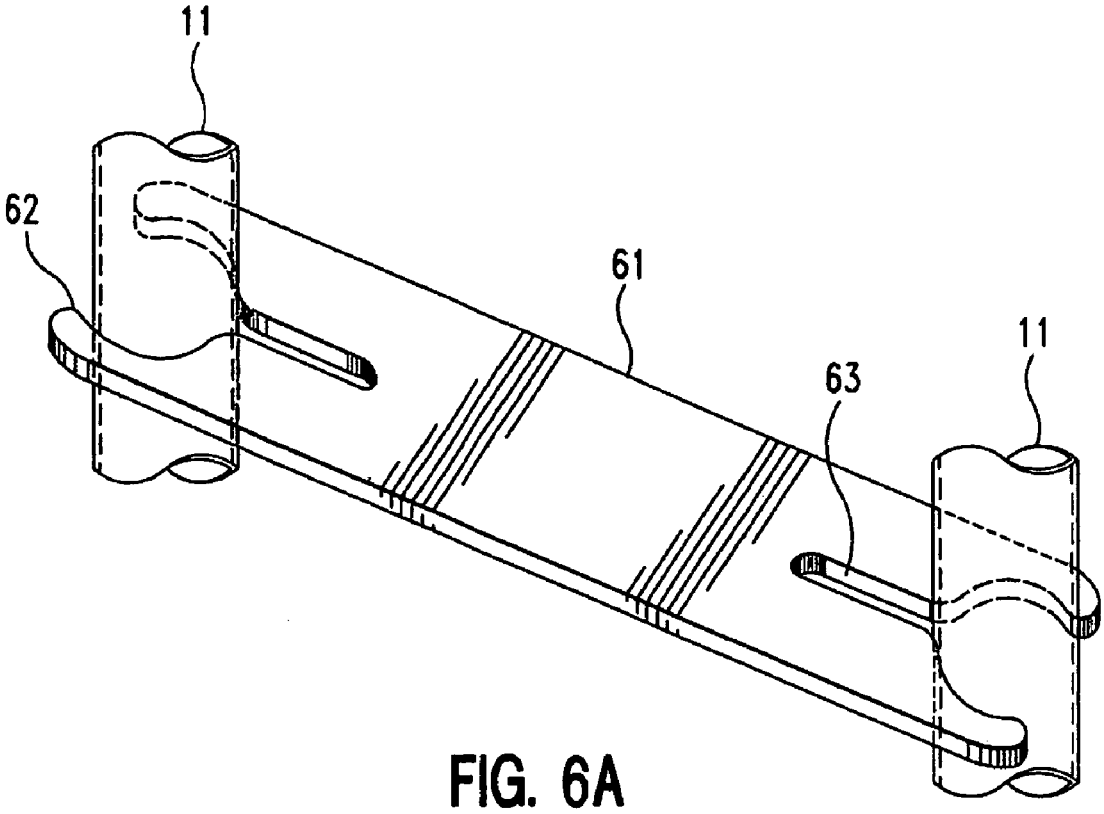
FIG. 6A is a perspective of a snap-on tool used toward the bottom of adjacent posts for post placement.
Figure 6B:
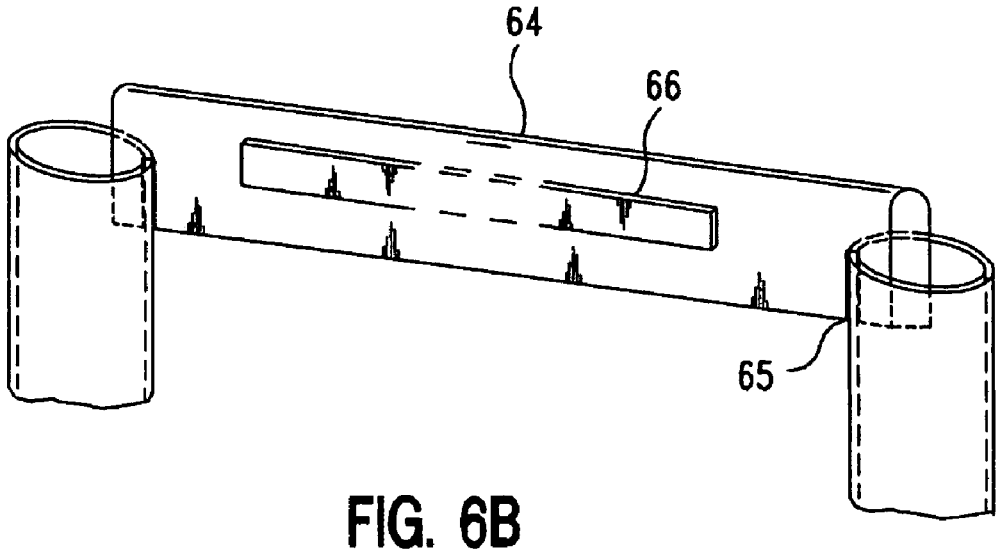
FIG. 6B is a perspective of a pole-spacing tool used simultaneously with the tool depicted in FIG. 6A, but at the tops of the posts.

To assure consistent, precise pole spacing during installation to very close tolerances, typically six feet, and referring to FIGS. 6A and 6B, after a first post 11 has been installed in a vertical position, a bottom locating tool 61 is snapped on to the first installed post 11 at ground level and the next post 11 is snapped on to the opposite end of tool 61. Tool 61 has a circular opening 62 at each end with a slot 63 extending therefrom so that it can be opened and closed and snapped onto the posts 11.

Referring to FIG. 6B, second top locating tool 64 such as a trim piece with notches 65 is then slid on to the first and next posts 11 on the top ends of the posts 11, thereby maintaining proper spacing at the top ends of the posts 11 as well. The top tool 64 is so constructed that a level 66 may be positioned therein to control the height of the posts 11 as well. With the poles 11 so positioned, cement, gravel, soil or equivalent is packed solidly at the base of the poles 11. After curing of the cement, the tools 61 and 64 are removed.

Figure 7A:
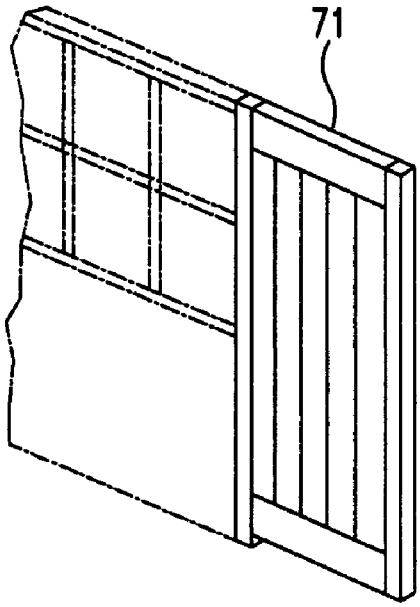
FIG. 7A is a fragmentary, perspective view showing the use of the main body or panel as a window shutter.
Figure 7B:
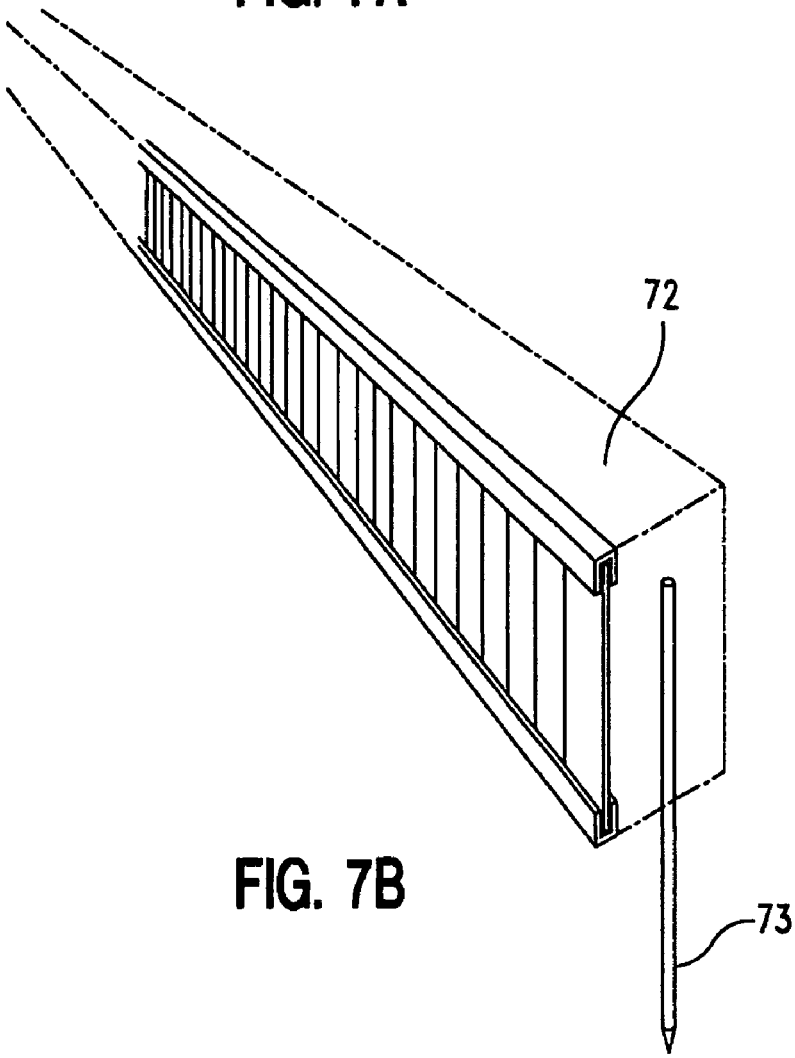
FIG. 7B is a fragmentary, perspective view showing the use of the main body or panel as a low barrier like a hedge.

Thus far the main bodies or panels 12 have been shown in connection with a fence assembly. Alternatively, the panels could be used as shutters (71 in FIG. 7A) or as a low barrier like a hedge (72 in FIG. 7B) anchored with ground stakes 73.

Figure 8A:
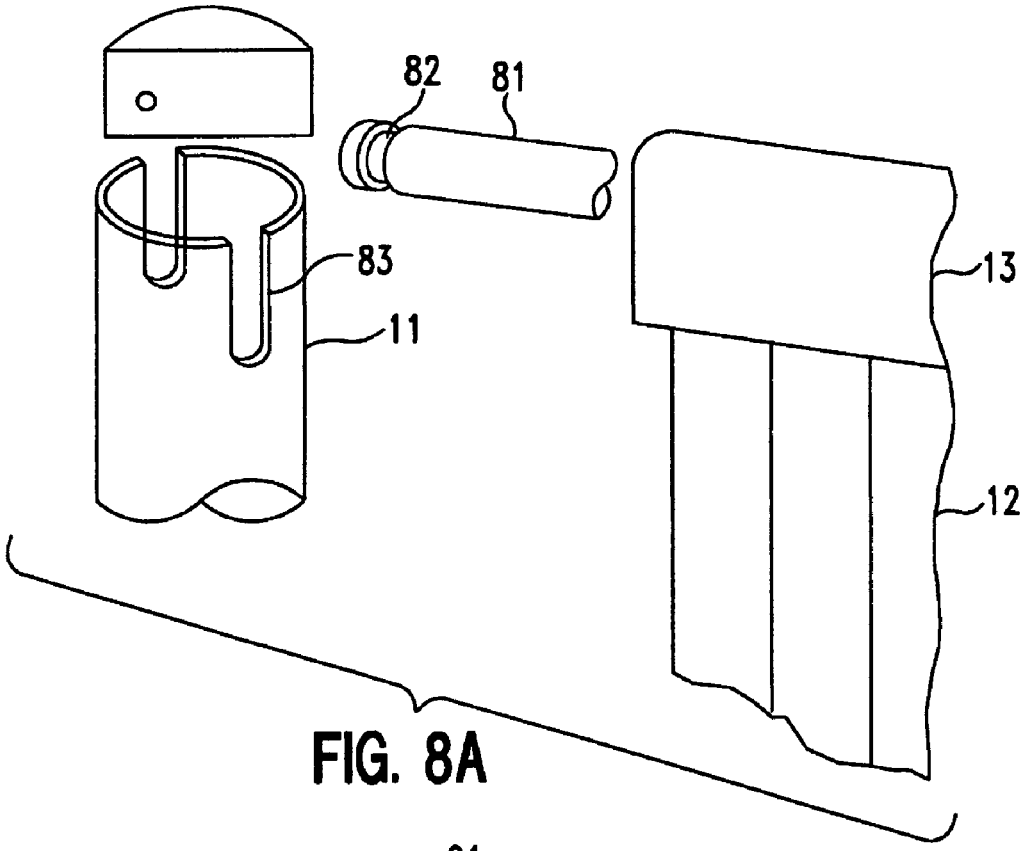
FIG. 8A is a fragmentary, exploded view of an alternate embodiment for supporting the main bodies or panels on the posts.

Referring to FIG. 8A, instead of the short pins 55 illustrated in FIG. 5C for support and pivoting of the panels, a single bar 81 passes entirely through the trim 13. Bar 81 is grooved at 82 and fits within a slot 83 at the top of the vertical post 11. Where pivoting is about the bottom, a similar bar may be used.

Figure 8B:
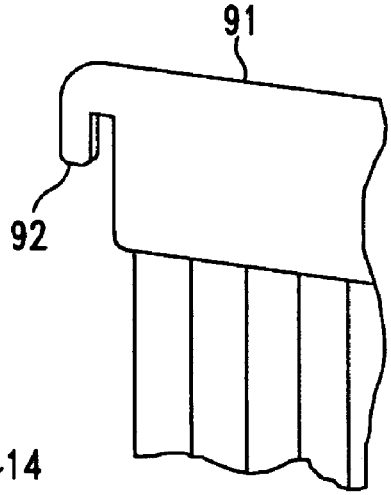
FIG. 8B is a fragmentary, perspective view of an alternate embodiment of the trim used when no pivoting action of the panel is contemplated.

If one resides in a location where wind velocity is minimal and thus no pivoting action of the fence panels is needed and contemplated, then, referring to FIG. 8B, the trim 91 is provided with a hooked end piece 92 that can be set down in a slot in the vertical post such as the slot shown at 83 in FIG. 8A.

A further alternate embodiment of the fence assembly of the present invention is shown in FIGS. 10A through 10F. Instead of using fence panels that may be of vinyl siding such as shown and described earlier, the fence assembly includes a corrugated or accordion-shaped panel 101. It can give the panel extra thickness and added stiffness than say the panels made up of house siding. This allows one to have much longer panels and wider spacing between fence posts. The panel 101 can be of metal say aluminum, plastic and the like. Added thickness provides more resistance against the wind bending it.

Figure 10A:
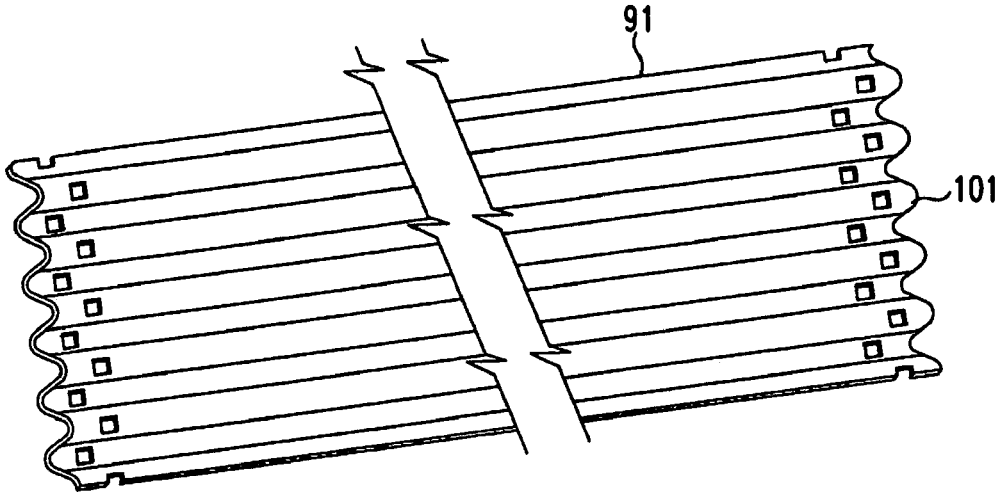
FIG. 10A is a fragmentary view showing corrugated panels with milled slots.
Figure 10B:
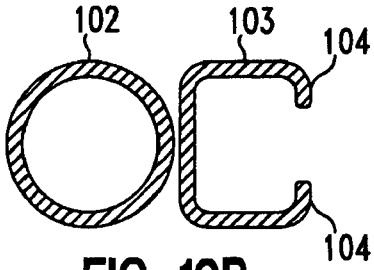
FIG. 10B is a sectional view of a side trim adjacent to a fence post.
Figure 10C:
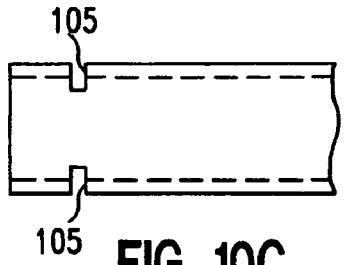
FIG. 10C is a top view of the end of a corrugated panel.

FIG. 10B is a top view of a fence post 102 and trim 103 that fits onto the end of the corrugated panel 101. Trim 103 is provided with projections 104 for snapping into milled slots or notches 105, although the ends could be squared off FIG. 10C is a side view of a panel 101 showing the notches 105. The trim 103 can be slid or snapped into the slots 105.

Figure 10D:
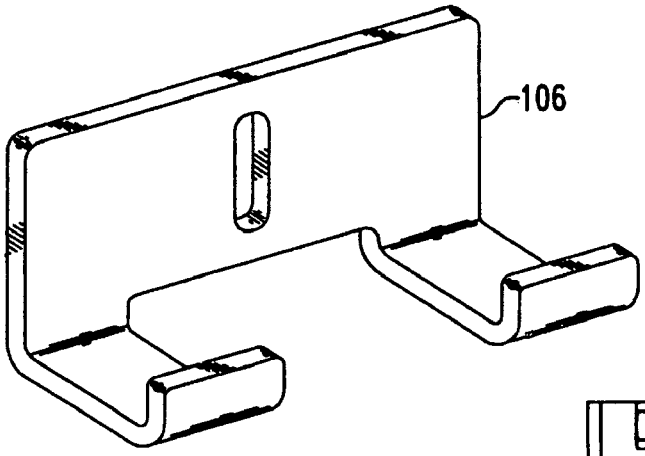
FIG. 10D is a perspective view of a locking bracket for capturing the side trims on both sides of the fence post of FIG. 10B when wind-through pivoting is not wanted.

In many situations a person may not be concerned with the panel movement caused by the wind forces, in which case a lock 106, as shown in FIG. 10D, can be fitted over the ends of adjacent panels and against the fence post and affixed to the fence post at the base of adjacent panels by means of a screw (not shown).

Figure 10E:
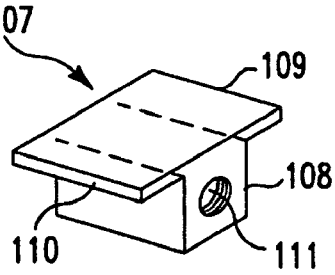
FIG. 10E is a nut for placement on the top of the fence post of FIG. 10B.

This embodiment also lends itself to pivoting action of the panels 101. In FIG. 10E is shown a nut 107 having a lower part 108, upper flanges 109, 110 and a threaded bore 111 therethrough.

Figure 10F:
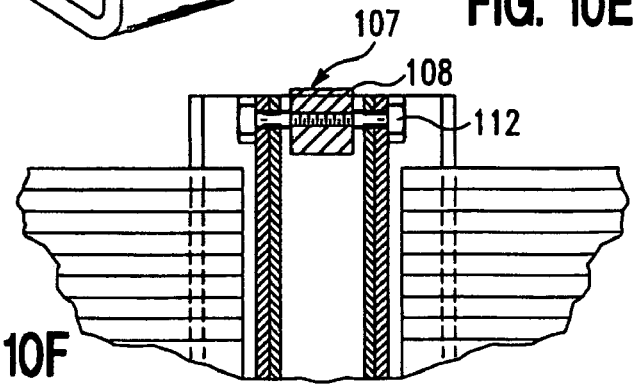
FIG. 10F is a fragmentary side view of the fence post of FIG. 10B sandwiched between the trims of two adjacent corrugated panels.

Referring to FIGS. 10E and 10F, the nut 107 is dropped into the post 102, with the flanges 109,110 coming to rest on the top of the post, the bore 111 being positioned transversely of the nut such that the bore is slightly above the top of the post. A bolt 112 is passed trough trim 103, post 102 on both sides, threaded through the bore 111 and locked in place and provides the pivot point for the panels 101.

Figure 11A:
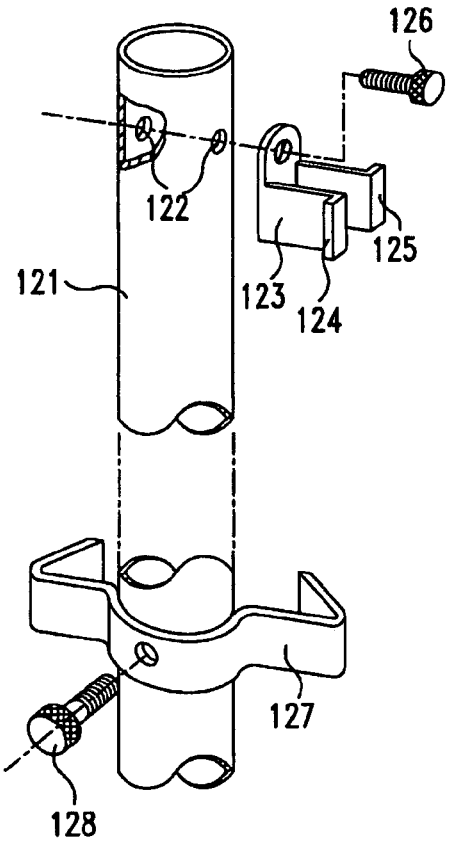
FIG. 11A is a fragmentary side view of an alternate embodiment of the present invention showing the fence post, upper pivot attachment and lower trim lock.
Figure 11B:
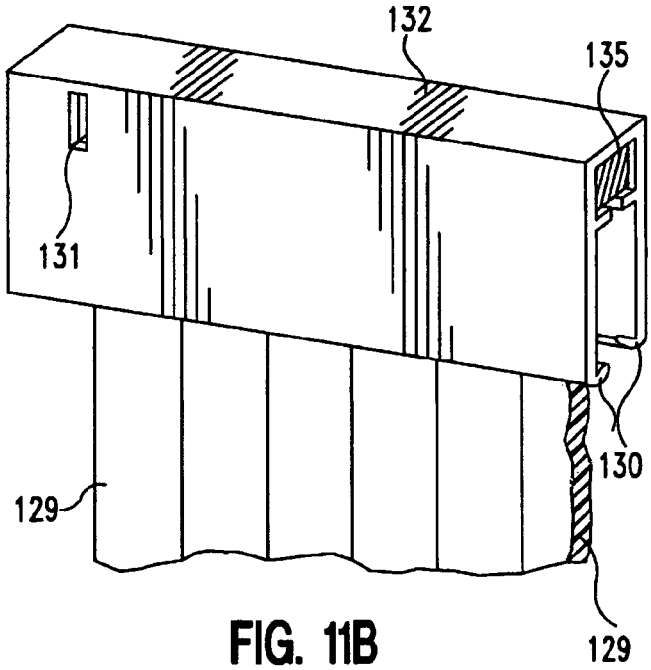
FIG. 11B is a fragmentary perspective view of the upper trim and panel for attachment to the fence post attachment depicted in FIG. 11A.
Figure 11C:
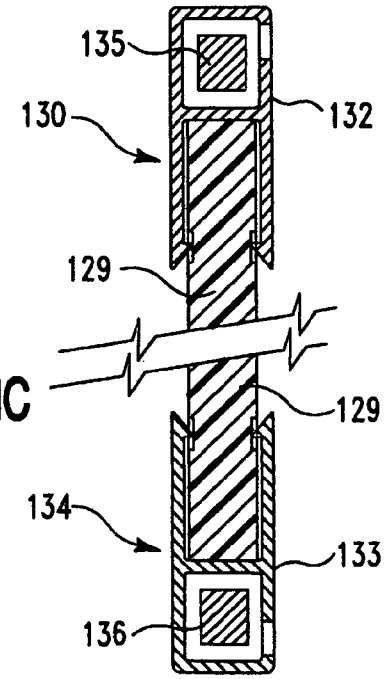
FIG. 11C is a fragmentary side view of the upper and lower trim and panel of FIG. 11B.

FIGS. 11A through 11C disclose an alternate embodiment for permitting pivoting of the fence panel, for locking the panels in place and for stiffening the trim.

Referring first to FIG. 11A, the fence post 121 can be a steel post and of smaller diameter than the post in previous embodiments and is provided with extruded holes 122 (one on either side for each adjacent panel and trim). A pivot member 123 with outwardly extending feet 124,125 is attached to the post 121 (on either side) by means of knurled head shoulder screws 126. The figure also depicts a lower trim lock 127 that is attached to the lower part of the post 121 by means of screw 128 threaded through the lock 127 and into the post 121.

FIGS. 11B and 11C show the fence panel 129 and upper trim 130. The walls of the trim are provided with vertical slots 131 into which the feet 124,125 of the pivot 123 snap. The square, upper chamber 132 of the upper trim 130 and the square lower chamber 133 of lower trim 134 trim are provided with tubular stiffening members or rods 135, 136 of square cross-section. The stiffening members 135, 136 are slid into the chambers 132 and 133 to prevent possible bowing during very heavy winds.

Figure 12:
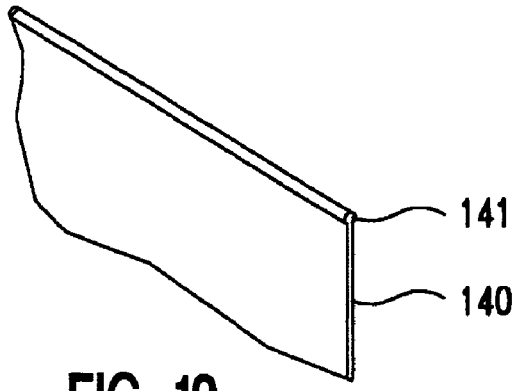
FIG. 12 is a fragmentary, perspective view of a panel beaded at its upper end.
Figure 13:
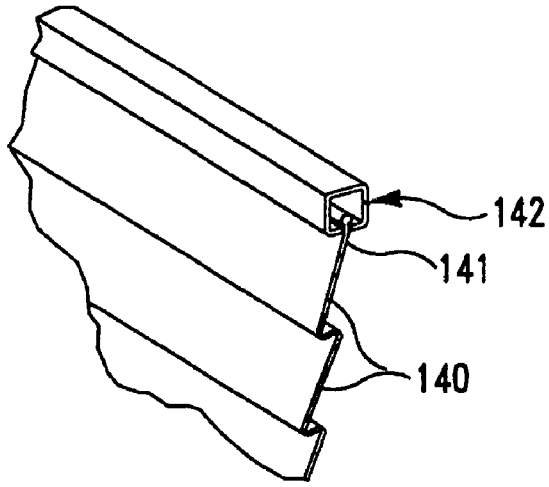
FIG. 13 is a fragmentary, perspective view of an upper beaded panel with trim piece.

Referring now to FIG. 12, one may provide each panel 140 with a bead 141 at the upper end and a trim piece 142, as shown in FIG. 13, eliminating the need for panel notching. Although the beading is illustrated at the top end, it is to be understood that the beading can be placed at the bottom end or both ends, as desired.

Figure 14:
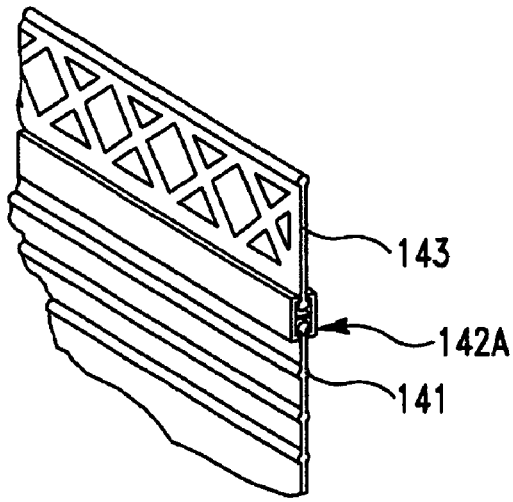
FIG. 14 is a fragmentary, perspective view of an upper beaded panel with trim piece and added decorative portion.

Further, as shown in FIG. 14, the upper trim 142A can have an upper open chamber into which a decorative portion 143 may be positioned, for aesthetic reasons.

Figure 15:
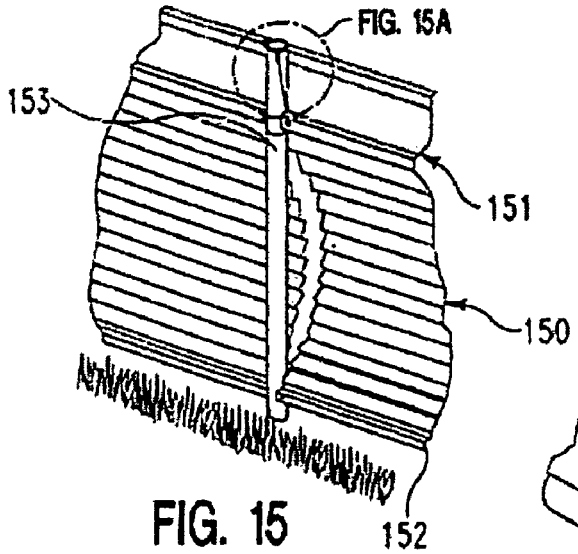
FIG. 15 is a fragmentary, perspective view, partially exploded, of an alternate embodiment of the present invention in which brackets attaching the panel to the vertical post are allowed to slide along the fence post.
Figure 15A:
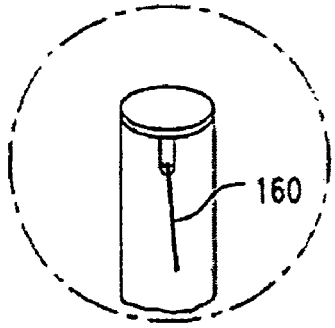

The embodiments described thus far require clearance on both sides of the fence for wind passage. In accordance with a further, preferred embodiment of the invention, the center section of each fence panel is allowed to bow for wind passage over or under the fence assembly. As shown in FIG. 15, there is a flexible panel 150 made up of a plurality of joined-together sheets, for example, vinyl, aluminum and the like with upper 151 and lower trim 152. The panel is attached to the vertical posts 153 by brackets. In accordance with the teachings of the present invention, either the upper brackets or the lower brackets can slide along, but are not affixed to the posts. In the FIG. 15 embodiment the lower bracket is fastened to the post 153, while the upper bracket is free to slide down the post and will bow in response to high wind.

Figure 16:
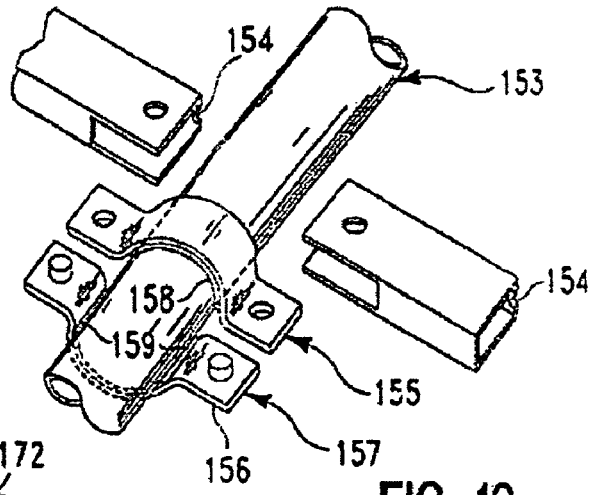
FIG. 16 is a fragmentary, perspective, exploded view of the bracket pane post assembly at the lower end of the fence assembly.

In FIG. 16, the invention is illustrated where the lower brackets can slide up and down the vertical posts. The trim pieces 152, slit at 154 for panel insertion are held within the bracket made up of upper member 155 and lower member 156 with extruded weld nuts 157 or equivalent. The bracket can slide along, but is not affixed to the post 153. Each member 155, 156 is provided with a nylon or Velcro™ or equivalent insert 158, 159 to aid in the sliding process.

In this manner, and in response to high wind, the panel will bow, allowing wind passage through the fence. The force of the wind will cause the brackets, either at the upper end, as illustrated in FIG. 16, or, as illustrated with the bracket arrangement in FIG. 16, at the lower end, or both ends to slide down or up, or in both directions, respectively, and thereby allow wind passage through the fence assembly.

Where the lower trim is fixed to the post, a counterweight system such as that shown in FIG. 4 may be employed with the cable 160 attached to both adjacent panels 150. But a counterweight system is not required, when the resilient strips bridge the panels.

This sliding bracket embodiment enables an appreciable increase in the spacing between fence posts. The post's rigidity is assured due to minimized wind resistance.

The fence assembly designs of the present invention permit thinner flexible materials that can simplify manufacture and provide other advantages such as lightweight and quick interchangeable and removable fence sections and allows for easy storage.

Figure 17:
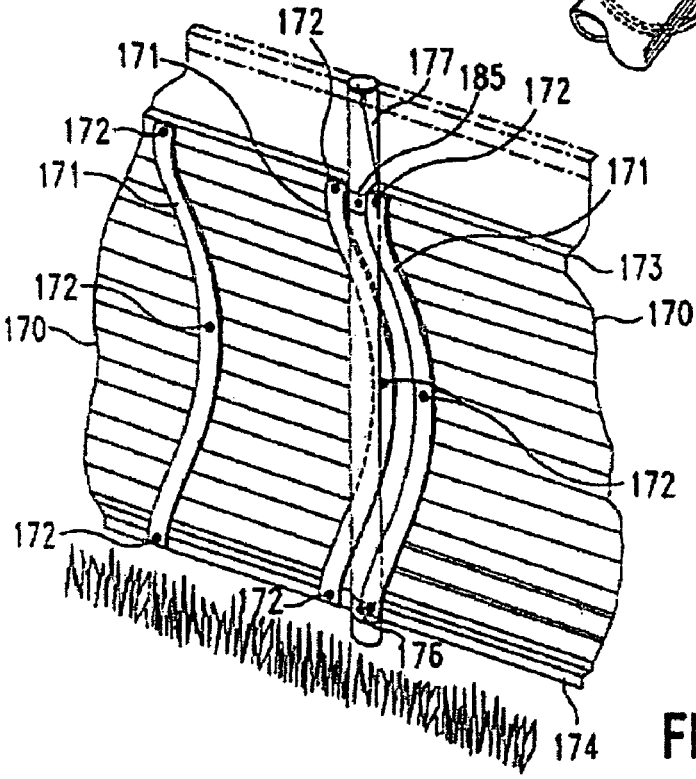
FIG. 17 is a fragmentary, perspective view of a further alternate embodiment.

FIG. 17 illustrates a further embodiment of the sliding arrangement of the present invention. The ends of the resilient panels 170 are provided with resilient strips 171 that are riveted to the panels 170 at 172 and attached to the upper 173 and lower trim 174. The trim pieces are in turn attached to brackets 175, 176 that can slide along the vertical posts 177. The arrangement assures that panel 170 and strips 171 will bow in the same direction. Additional strips 171 may be spaced along the panels 170.

Figure 18:
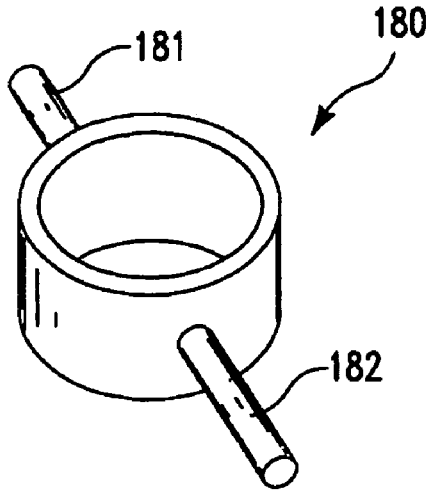
FIG. 18 is a perspective view of an alternate upper sliding sleeve.

Referring to FIG. 18, there is shown a sliding sleeve casting 180 (upper or lower) with pivot pins 181,182. The sleeve 180 fits about the vertical post and its pins 181, 182, fit into the adjacent trim pieces. Pins 181, 182 allows for angular changes of the fence panel trims. The upper and lower trims will be allowed to swivel, thus allowing greater responsiveness to light breezes. The sleeve 180 can be used in connection with the fence assembly shown in FIGS. 15-17, as well as with the other embodiments shown in the remaining Figs. and facilitates installation and removal of panels from a fence assembly.

Figure 19:
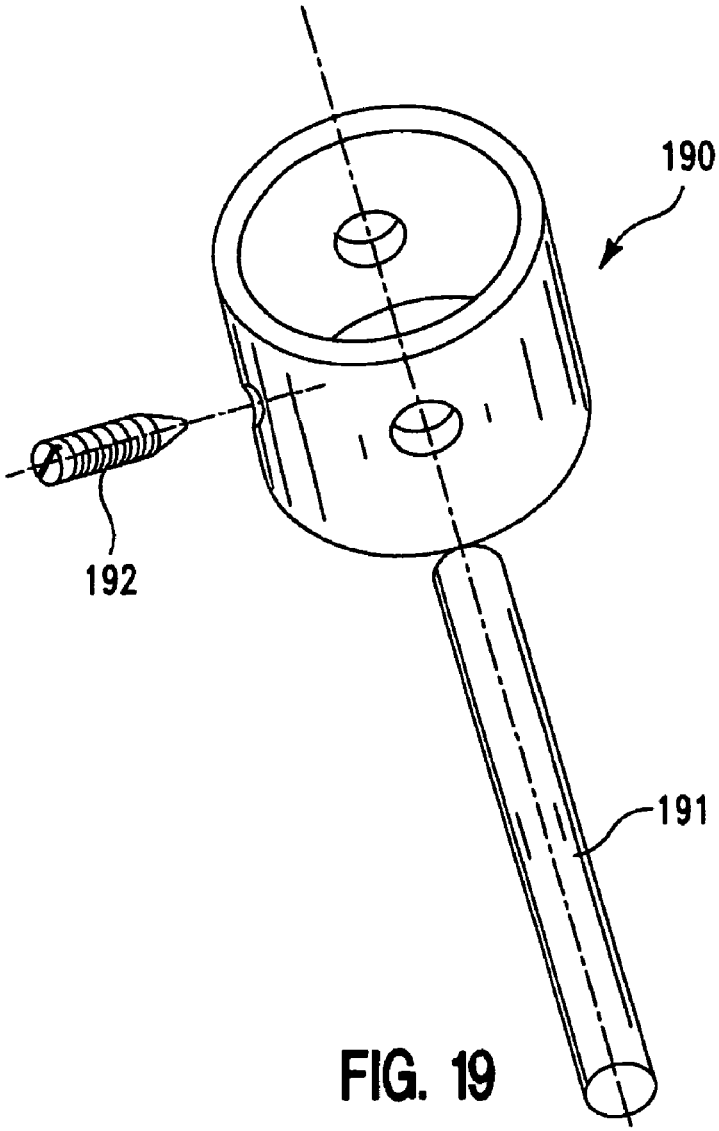
FIG. 19 is a perspective view of an alternate lower locking collar.

Referring to FIG. 19 there is shown an alternate locking collar 190. The collar 190 is slide around a fence post with its openings aligned with openings in the fence post. A pin 191 is slid through the openings in the collar 190 and the openings in the fence post. The protruding ends of the pin 191 are inserted into adjacent trim pieces, allowing the swivel action of the lower trim similar to the FIG. 18 embodiment. The cone head set screw 192 locks it in place.

Figure 20:
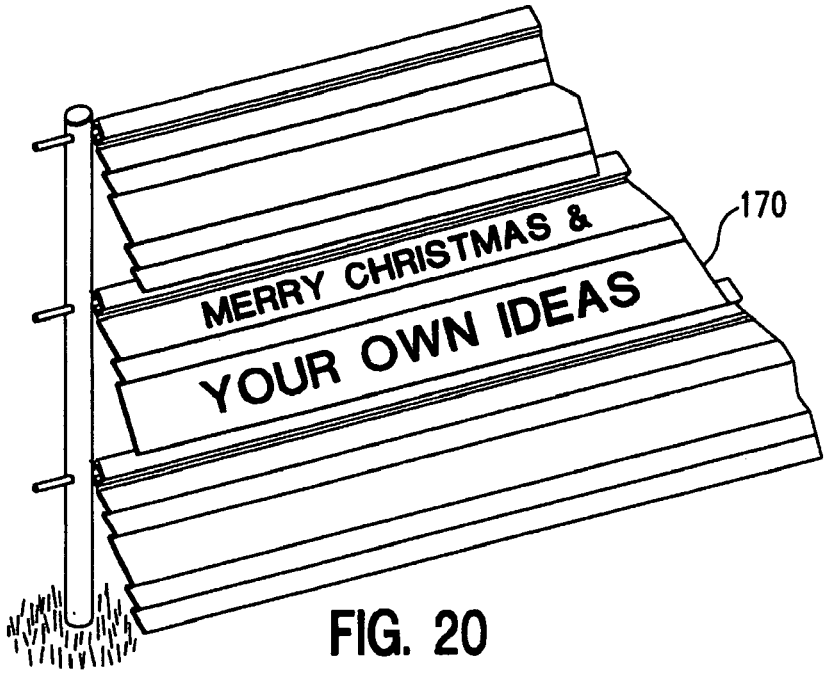
FIG. 20 is a fragmentary perspective view showing at least one of the fence assembly panels bearing indicia.
Figure 21:
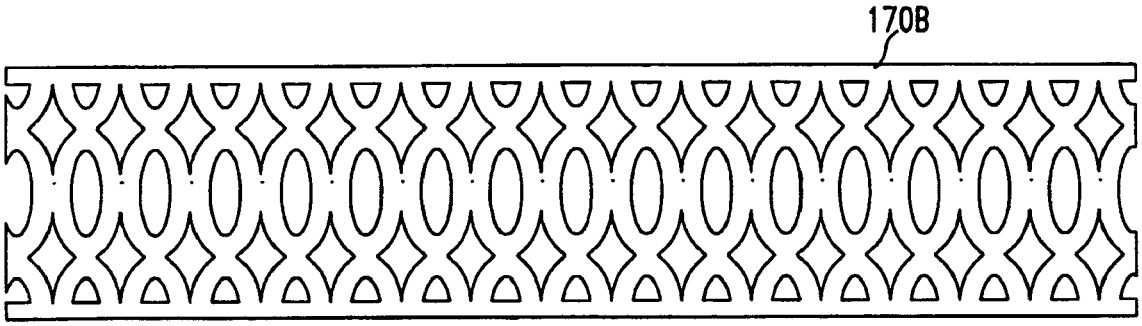
FIGS. 21 and 22 are fragmentary side views of panels in which a pattern has been cut.
Figure 22:
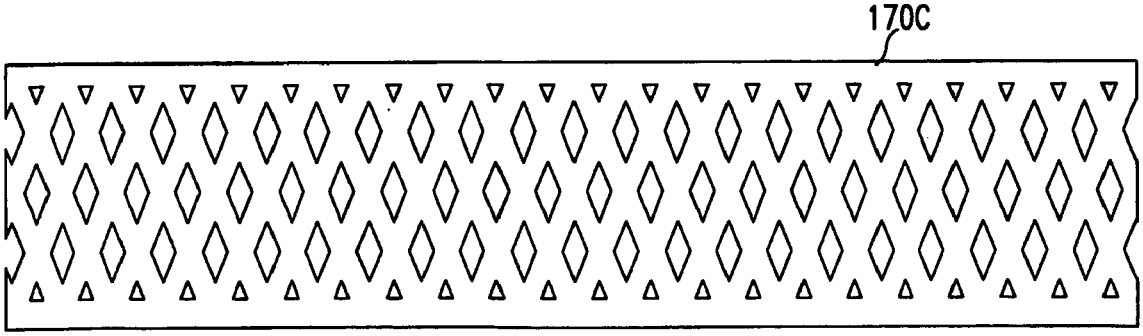
Figure 23:
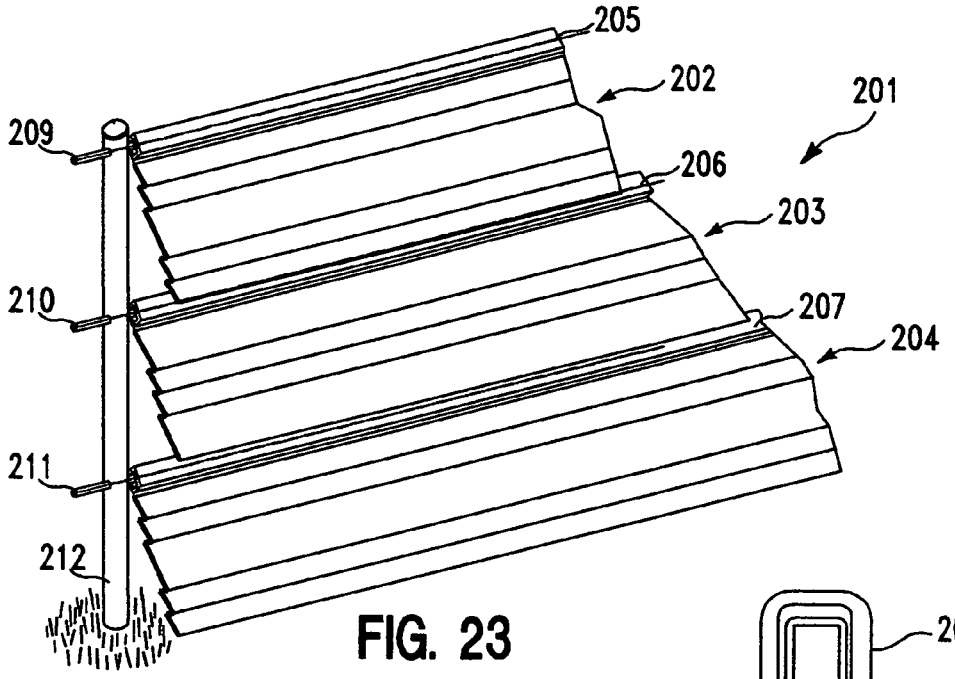
FIG. 23 is a fragmentary perspective view of a preferred, alternate embodiment of the present invention.
Figure 24:
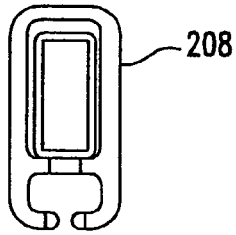
FIG. 24 is a cross-sectional view of the upper trim piece used in the FIG. 23 embodiment.

If desired, and as shown in FIG. 20, customers can be given a panel 170 to print desired indicia thereon, or decorative panels as shown in FIGS. 21 and 22, can be provided wherever a customer desires, as by cutting or displaying a pattern into or on the panels 170B and 170C.

Referring to FIGS. 20 and 23-25, a preferred embodiment of the present invention is disclosed. The fence assembly 201 comprises multiple, flexible, horizontal panels 202, 203 and 204. Each panel may be made up of joined-together sheets. Optionally, the panel may be a single piece with a bead along its upper edge.

Trim pieces 205, 206 and 207 have an upper portion through which a steel tube stiffening member 208 (FIG. 24) passes and a lower portion that snaps onto the upper edges of the panels 202-204. Aluminum pivot pins 209 (FIGS. 23 and 25), 210 and 211, approximately ¼-⅜ inch in diameter, are press fit through adjacent, PVC, vertical posts 212. The near ends of pins 209-211 pass into the trim stiffening member 208. Optionally, a pin insert cover (not shown) may be added at the end of the trim piece, for aesthetic reasons.

With the panels thus mounted, the fence assembly is allowed to pivot under a wind's force.

The lower trim pieces 206, 207 have a controlled interference with the bottom edges of the panels 202, 203 above. The interference improves privacy while allowing the panels to flip over when the wind reverses direction. Also, this assembly facilitates cutting grass adjacent to and under the lowest panel.

Velcro tape could also be applied where the panel and trim pieces interfere. This would insure a forceful wind requirement for the 'wind thru' fence assembly to function.

Figure 26:
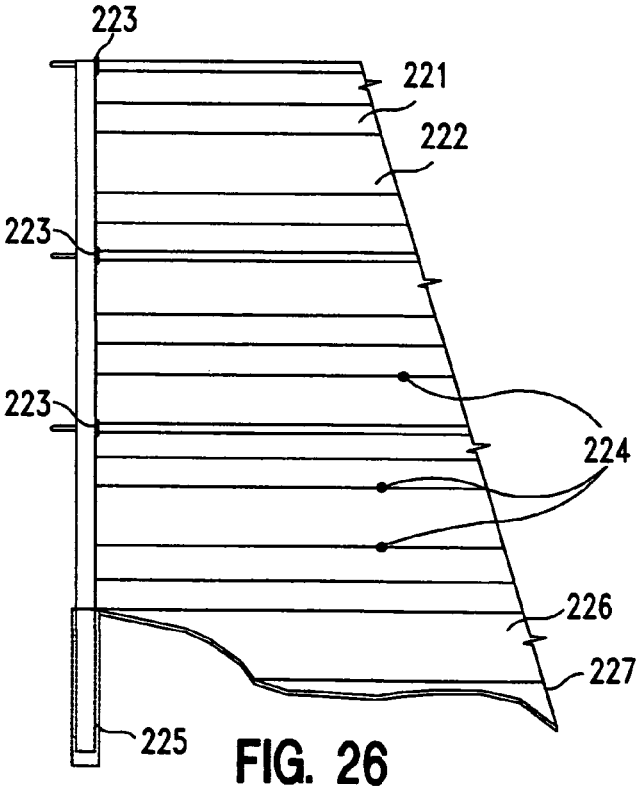
FIG. 26 is a fragmentary perspective view of another, preferred, alternate embodiment of the present invention.
Figure 25:
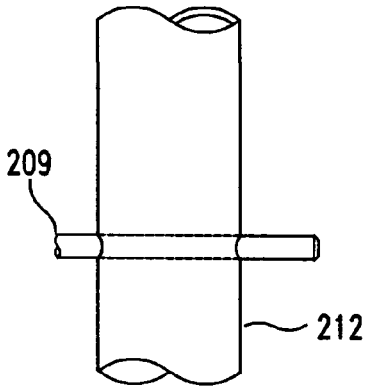
FIG. 25 is a fragmentary perspective view of the posts utilized in the FIG. 23 embodiment, with pivot rod press fit therethrough.

To enhance the aesthetics of the fence assembly, the heights of the individual horizontal panels may be varied, as shown in FIG. 26. Thus, and by way of example, one can have panels 221 of four inch height and other panels 222 of 8 inch height.

Optionally, a nylon washer at 223 may be sandwiched on the pivot pins between the fence post and the panel trim to prevent a noise from the post rubbing against the trim.

After a period of time, the panels may move back and forth and slide towards the post. To prevent this, and as shown in FIG. 26, rivets 224 are placed through adjacent panels to prevent lateral movement.

When the terrain beneath a fence assembly installation changes, the fence post may be lengthened as shown at 225 in FIG. 26 and additional panels may be added as shown at 226, 227 in FIG. 26.

The fence assembly of the present invention offers negligible wind resistance. It enables increased fence post spacing. The addition of en extra trimmed length enables fence/ground contact without destroying alignment. It permits fast and easy interchange of fence panels and a wider array of color choices. If desired, a user can have panels customized to a particular decorative design. Costs of materials, manufacture, storage, transportation and installation are greatly reduced.

The present "in ground" support of fence posts usually requires an oversized hole with a need for cement before or after the fence post has been positioned. In the past, a steel support below grade has not been utilized because of the problem with post deterioration due to rusting.

Figure 27:
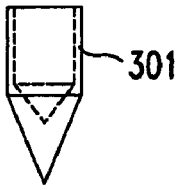
FIG. 27 is a perspective view, partially in phantom of a steel casting.
Figure 28:
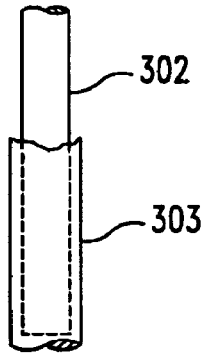
FIG. 28 is a fragmentary perspective view, partially in phantom of a steel bar (rebar) with shrink tubing.

To overcome this, and referring to FIGS. 27 and 28 there is shown a steel casting 301 to be slid on the bottom of a steel bar (rebar) 302. Typically, bar 302 is 4 feet long and in use half will be driven into the ground. Optionally, a powder coat may be painted over the entire surface of bar 302. A shrink tubing 303 is disposed over the entire length of the bar 302.

Figure 29:
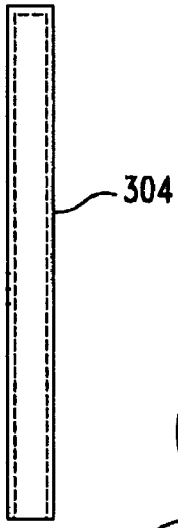
FIG. 29 is a side view, partially in phantom, of a protective installation tube.

FIG. 29 discloses a thin wall, protective tube 304, typically 2 feet long with an internal cap at its upper end. The tube 304 will be used when penetrating the ground with the bar 302 to protect the shrink tubing 303 during installation.

Figure 30:
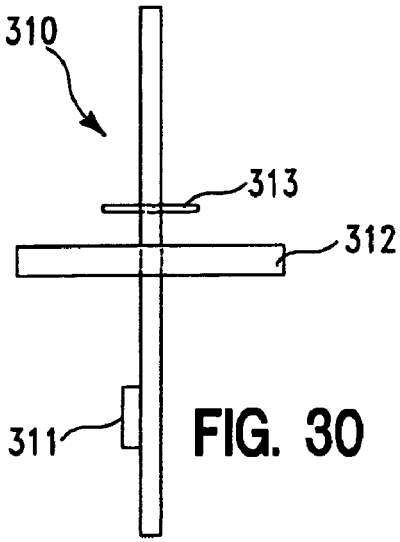
FIG. 30 is a view, of a steel installation tool.

FIG. 30 discloses a bar installation tool 310 comprising vertical tubing 311, horizontal tubing 312 affixed to tubing 311 and horizontal bar 313 positioned above and spaced from tubing 312.

Figure 31:
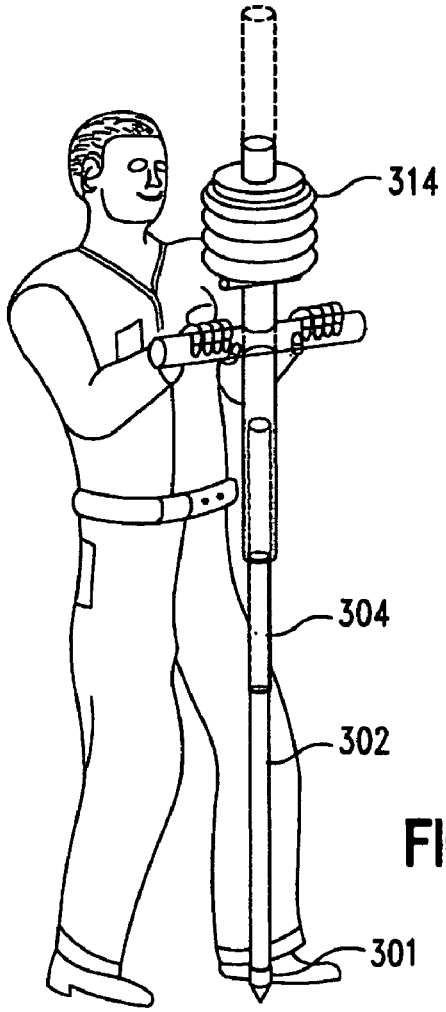
FIG. 31 is a perspective view, partially in phantom, of the tool of FIG. 30 being used to install a steel bar.

In use, and as shown in FIG. 31, to drive bar 302 with its leading casting 301 into the ground, the casting 301 is pressed against the ground with bar 302 in vertical position. Weights 314 are slid on the vertical tubing 311, and rest on the bar 313. The installer then places the tubing 311 over the bar 302 with the thin wall tube 304 positioned between the bar 302 and tubing 311 to protect the shrink tubing 303. The installer then raises and lowers the tool 310, thereby driving the bar 302 into the ground, typically to a depth of 2 feet, leaving 2 feet exposed.

Thereafter, a post from a fence assembly may be slipped onto the bar 302, the top of the bar 302 coming to rest against the lowermost pin in the fence assembly.

Figure 33:
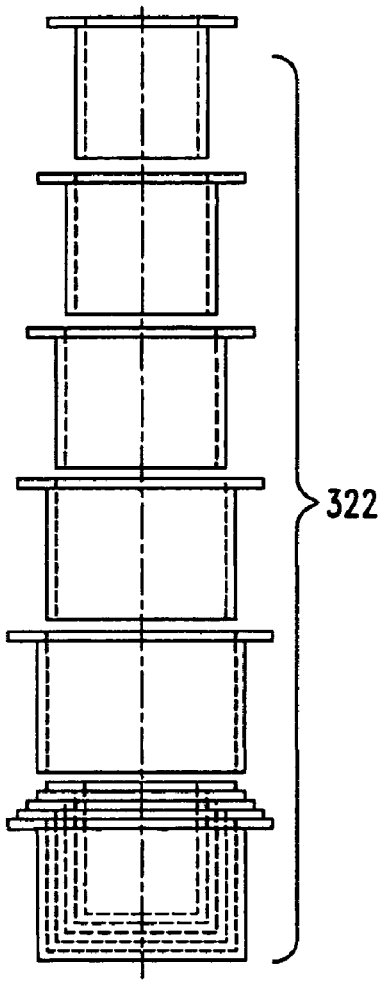
FIG. 33 is a schematic, side view, partially in phantom of flanged sleeves to accommodate bars of varying diameters; and, FIG. 34 is a side, cutaway view of the doughnut sensor of FIG. 32.
Figure 32:
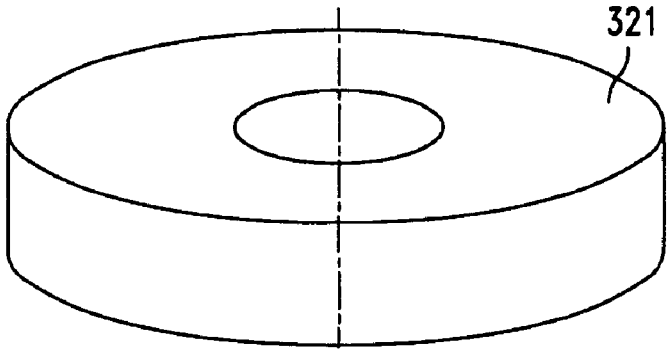
FIG. 32 is a perspective view of a sensing doughnut for proper vertical positioning of the steel bar.

To assure perfect vertical alignment of the bar 302 during installation, and referring to FIG. 32, a sensing doughnut 321 is placed about the bar 302. A plurality of flanged sleeves 322 of varying diameters, as shown in FIG. 33, that can be nested, may be placed within the doughnut hole to accommodate bars of varying diameters.

Figure 34:
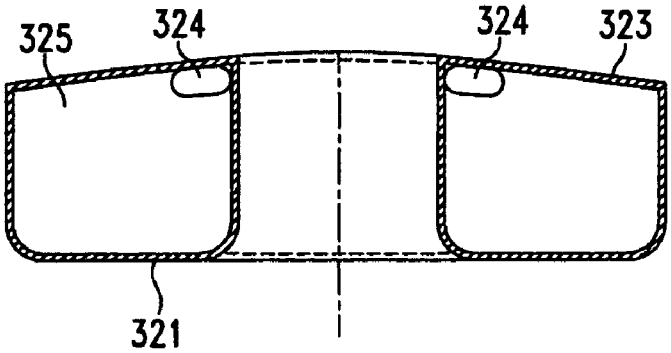

The sensing doughnut is seen, in FIG. 34 as being hollow, with a slightly curved, transparent cover 323, and an air bubble 324 in the doughnut's internal fluid 325. The fence assembly of the present invention is light in construction and can be built at small cost. The top and bottom trims are identical until the pivoting pin slots are added. Both are made as an extrusion with any desired length. When subjected to wind pressure, the fence panels will bow, relieving the fence assembly of the force of the wind and ensuing damage. Forceful winds passage can occur without the need for large openings and extra cost of heavier construction.

The assembly is virtually maintenance-free.

There is extreme design flexibility that enables custom made fences with a choice of height, width and color.

The fence assembly of the present invention minimizes assembly time and manpower requirements because each fence unit has only three 'snap or slide together' components.

The assembly enables a maximum 'wind thru' area without fence panel removal.

The assembly uses gravity for automatic fence repositioning after any degree of wind passage.

Each panel is independently removable. Except in one embodiment involving a cone head set screw, no tools are required for installation or removal of panels and there is a 'lock-down' ability, when preferred.

When excessive fence lengths are desired with greater fence post spacing, presently marketed corrugated panels used for roofing can be used instead of house siding. The same 'snap-together' assembly method can be used or a 'slide' attachment of the panel and its trim. Only a wider trim is required with its attachment on each side, and the fence sheets vertically positioned.

It should be obvious that changes, additions and omissions may be made in the details and arrangement of parts without departing from the spirit and scope of the invention as hereinafter claimed.

What is claimed is:

1. A fence assembly having fence panels that may pivot under the force of wind, thus allowing wind flow through the fence, comprising:

a first and a second vertical fence post;

a plurality of vertically spaced elongate trim pieces extending from the first post to the second post, each having a hollow upper portion defined by a bore therethrough and a slotted lower portion;

pivot pins extending from the first and second fence posts into each end of the hollow upper portion of each of the trim pieces such that the trim pieces are rotatably mounted;

a plurality of single, flexible, horizontal fence panels of sheet material, each panel comprising:

an upper edge and a lower edge;

the upper edge having a bead along its length which snaps into the slotted lower portion of a respective trim piece;

wherein the lower edge overlaps an upper portion of an adjacent trim piece to form a controlled interference with the adjacent trim piece to improve privacy while allowing the panels to flip over the adjacent trim piece to blow in response to wind in either direction; and, gravity means for restoring the panel to its vertical position.

2. The assembly of claim 1 including a stiffening member extending through the upper hollow upper portion of each of the trim pieces.

3. The assembly of claim 1 wherein the panels are of varying height.

4. The assembly of claim 1 including a washer on the pivot pins sandwiched between the fence post and the trim pieces.

5. The assembly of claim 1, wherein each of the panels are made up of sheets and include riveting between adjacent sheets within a panel to prevent lateral movement of the sheets within the panel.

* * * * *